US006604287B2

(12) United States Patent
Melton et al.

(10) Patent No.: US 6,604,287 B2
(45) Date of Patent: Aug. 12, 2003

(54) HAIR CLIPPER WITH TETHERED TRIMMER ATTACHMENT AND ON-BOARD ATTACHMENT STORAGE

(75) Inventors: Scott Melton, Erie, IL (US); James McCambridge, Polo, IL (US)

(73) Assignee: Wahl Clipper Corporation, Sterling, IL (US)

( * ) Notice: Subject to any disclaimer, the term of this patent is extended or adjusted under 35 U.S.C. 154(b) by 43 days.

(21) Appl. No.: 09/955,802

(22) Filed: Sep. 19, 2001

(65) Prior Publication Data

US 2003/0051347 A1 Mar. 20, 2003

(51) Int. Cl.[7] ..... B26B 19/10

(52) U.S. Cl. ..... 30/123; 30/34.1; 30/122; 30/125

(58) Field of Search ..... 30/122, 123, 201, 30/34.05, 34.1, 125; D28/53, 54

(56) References Cited

U.S. PATENT DOCUMENTS

| | | | | | |
|---|---|---|---|---|---|
| 2,011,351 | A | * | 8/1935 | Yancey et al. | 30/201 |
| 2,196,599 | A | * | 4/1940 | Shryock | 30/123 |
| 2,291,438 | A | * | 7/1942 | Andis, Jr. | 30/123 |
| 3,183,591 | A | * | 5/1965 | Dumont | 30/123 |
| 4,614,032 | A | * | 9/1986 | Szabo | 30/122 |
| 4,622,745 | A | | 11/1986 | Wahl | 30/201 |
| 5,542,178 | A | * | 8/1996 | Harkleroad | 30/34.1 |
| 5,701,675 | A | * | 12/1997 | Hall et al. | 30/125 |

FOREIGN PATENT DOCUMENTS

| | | |
|---|---|---|
| EP | 443 680 | 8/1991 |
| EP | 965 419 | 12/1999 |
| WO | 00/10779 | 3/2000 |

* cited by examiner

*Primary Examiner*—Hwei-Siu Payer
(74) *Attorney, Agent, or Firm*—Greer, Burns & Crain, Ltd.

(57) ABSTRACT

A hair clipper has a housing and a pair of blades secured outside of the housing. One of the blades is stationary, and the other reciprocates. A hair trimmer or other attachment is tethered to the hair clipper so that it can be selectively placed over the hair clipper blades in use, but is not lost when removed from the blades. The attachment is stored in a recess in the housing when not in use.

11 Claims, 5 Drawing Sheets

HAIR CLIPPER WITH TETHERED TRIMMER ATTACHMENT AND ON-BOARD ATTACHMENT STORAGE

BACKGROUND OF THE INVENTION

This invention relates to hair clippers, and more particularly, to hair clippers having tethered trimmer attachments that can be stored in the hair clipper.

Conventional hair clippers are often sold with one or more blade attachments. Some attachments set the distance between the clipper blades and the head or face. An attachment that has hair trimmer blades will be described here.

When attachments are removed they can easily be misplaced. Thus, there is a need for hair clippers having tethered attachments. Storing hair clipper attachments is inconvenient and often disorganized. There is also a need to conveniently store hair clipper attachments in an orderly manner.

Accordingly, one object of this invention is to provide new and improved hair clippers.

Another object is to provide new and improved hair clippers having a tethered attachment.

Still another object is to provide new and improved hair clippers that store attachments in a convenient, orderly manner.

SUMMARY OF THE INVENTION

In keeping with one aspect of this invention, a hair clipper has a housing and a pair of blades secured outside of the housing. One of the blades is stationary, and the other reciprocates. A hair trimmer or other attachment is tethered to the hair clipper so that it can be selectively placed over the hair clipper blades in use, but is not lost when removed from the blades. The attachment is stored in the housing when not in use, preferably in a recess.

A variety of attachments can be used. One such attachment is a hair trimmer attachment that has a stationary blade and a moving blade that cut hair when the moving blade reciprocates. The moving blade of the attachment is driven by the moving blade of the hair clipper, which also reciprocates. The attachment has indentations and a snap that secure the attachment to the stationary blade or other part of the hair clipper when the attachment is in use. A drive member engages the moving blade of the hair clipper when the attachment is secured to the hair clipper in this manner, and the drive member in turn drives the moving blade of the hair trimmer attachment to cut hair.

The attachment also is attached to the hair clipper by a tether that is connected to the hair clipper on one end, and connected to the attachment on the other end. The tether itself can be stiff or flexible. The tethered attachment can be easily removed from the stationary blade and stored in the housing, so that the hair clipper blades can be used to cut hair in the usual manner.

BRIEF DESCRIPTION OF THE DRAWINGS

The above mentioned and other features of this invention and the manner of obtaining them will become more apparent, and the invention itself will be best understood by reference to the following description of an embodiment of the invention taken in conjunction with the accompanying drawings, in which.

DETAILED DESCRIPTION

Figure 1:
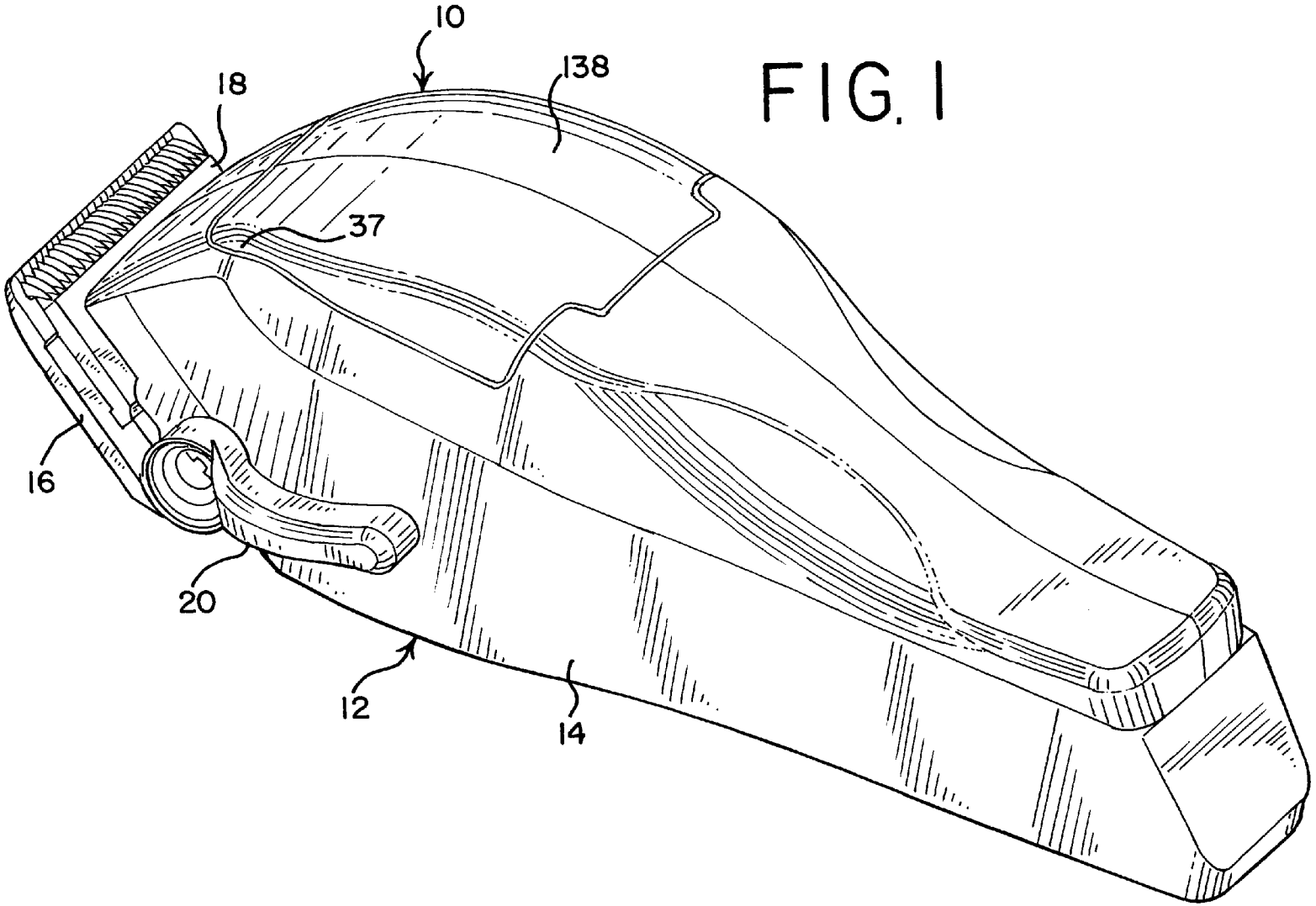
FIG. 1 is a perspective view of a hair clipper having an integral hair trimmer attachment made in accordance with this invention, shown with the attachment inside the clipper.

FIG. 1 shows a hair trimmer attachment 10, and a hair clipper 12 having a housing 14, a stationary blade 16 and a moving blade 18. The attachment 10 is secured to the housing 14 for storage purposes.

The blades 16, 18 have complimentary blade teeth separated by spaces. In operation, the moving blade 18 reciprocates across the spaces to cut hair that enters the spaces. The moving blade 18 can be driven by any suitable motor (not shown). The stationary blade 16 is secured to the housing 14, typically with screws (not shown). A blade height adjustment 20 can be provided to adjust the height of the moving blade 18 with respect to the stationary blade 16. The hair clipper 12 can be used to cut hair in the usual manner when the attachment 10 is in the housing, as in FIG. 1.

Figure 2:
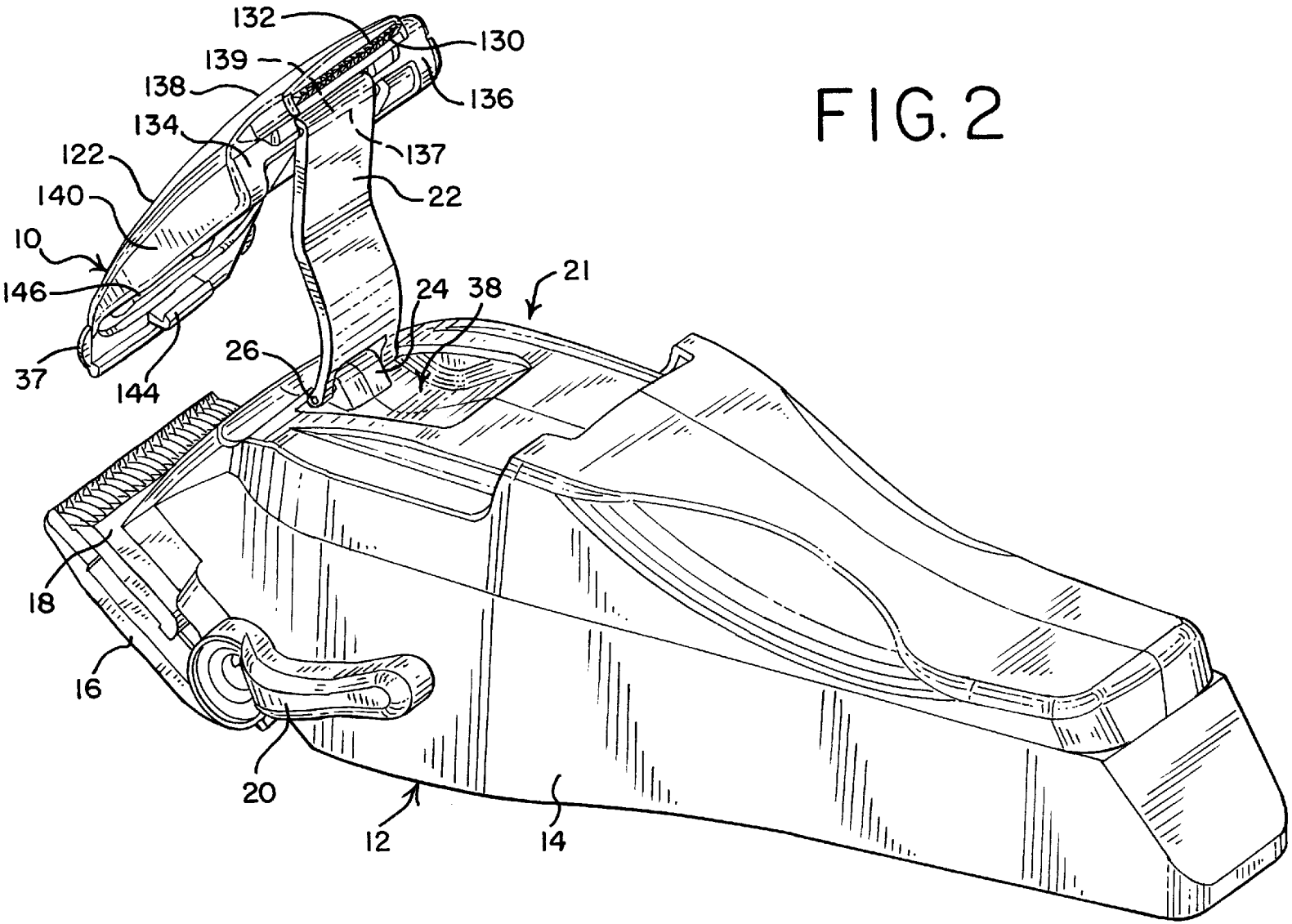
FIG. 2 is a perspective view of the hair clipper of FIG. 1, showing the hair trimmer attachment removed from the housing of the hair clipper.
Figure 3:
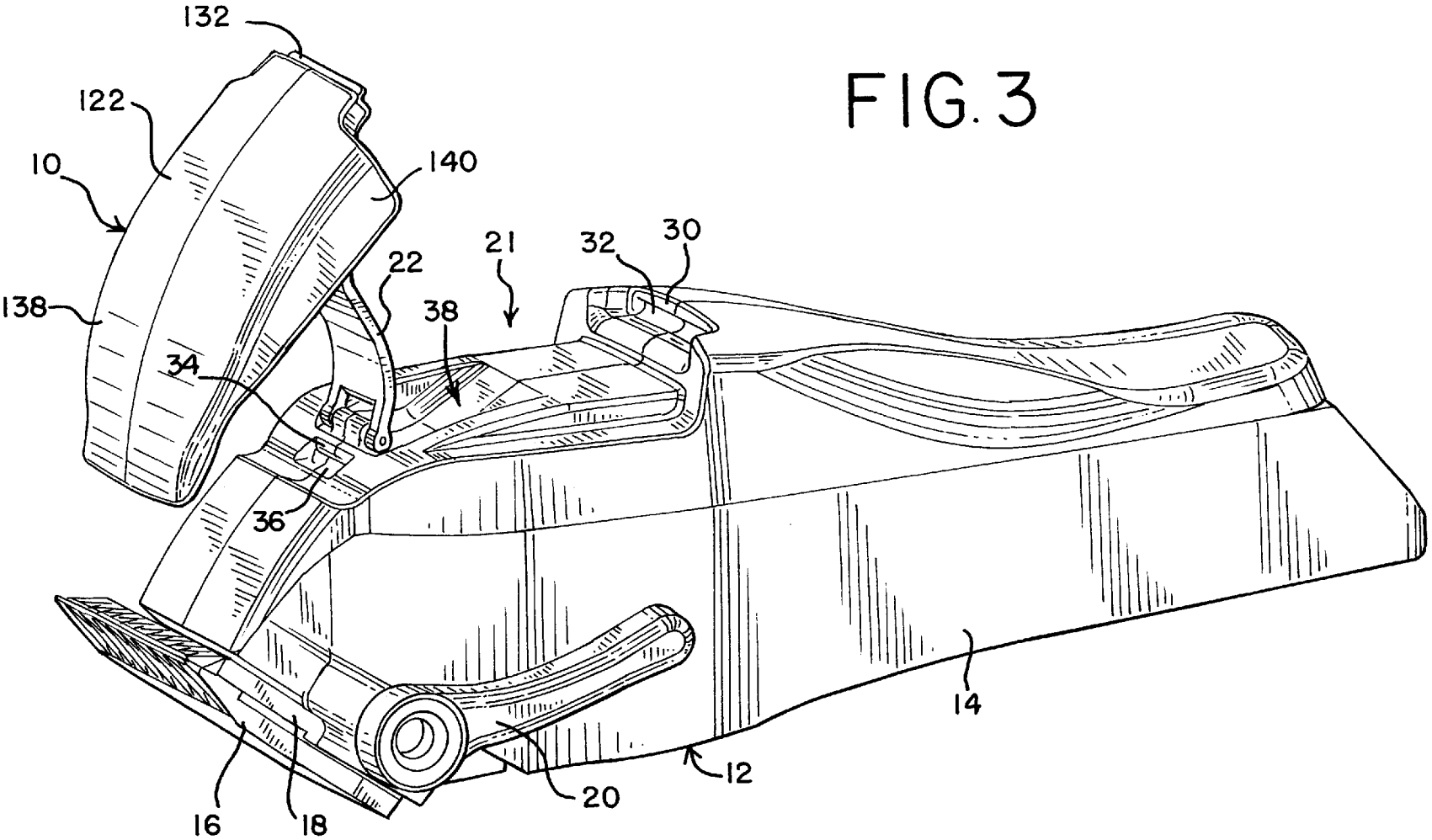
FIG. 3 is another perspective view of the hair clipper of FIG. 1, showing the attachment removed from the hair clipper housing.
Figure 4:
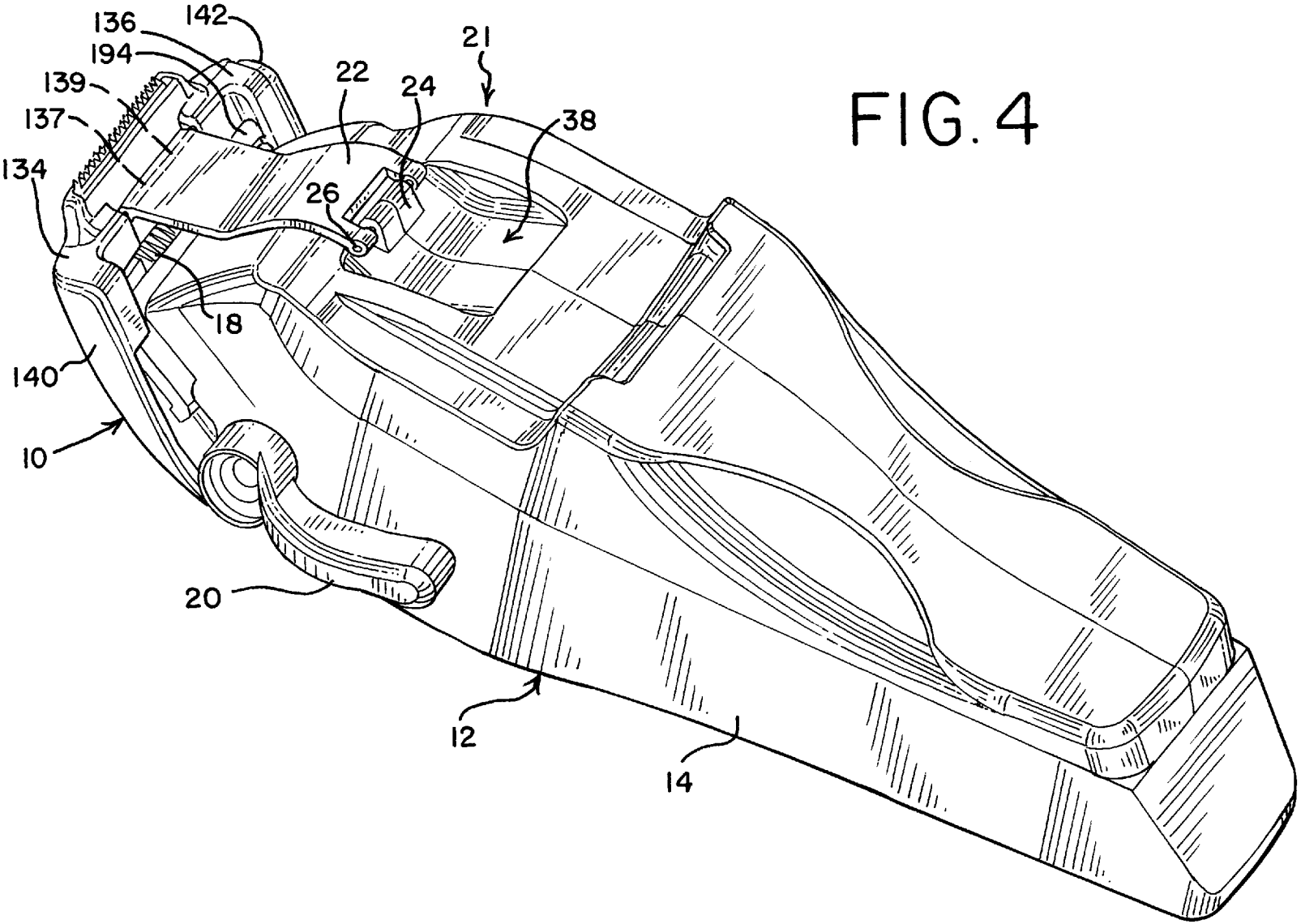
FIG. 4 is a perspective view of the hair clipper of FIG. 1, shown with the hair trimmer attachment secured to the stationary blade of the hair clipper.

FIG. 2 shows the attachment 10 removed from the housing 14. Thus, FIG. 2 reveals a recessed area 21 into which the attachment 10 fits for storage. FIGS. 3 and 4 also show this recessed area.

As seen in FIGS. 2 and 3, the attachment 10 is secured to the hair clipper 12 by a tether 22. The tether 22 can be a solid material such as metal or plastic, as shown, or it can be made of flexible material. In this embodiment, the tether 22 is flat and contoured to fit inside the recessed area 21, but it could also be round or any other suitable shape. One end of the tether 22 is hingedly secured to the housing 14, and the other end is hingedly secured to the attachment 10. The housing 14 includes at least one embossment 24. A pin 26 passes through an opening in the embossment 24 and openings provided in the tether 22 to secure the tether 22 to the hair clipper 12. The attachment 10 is also hingedly secured to the tether 22, as will be described.

The attachment 10 is described in greater detail in U.S. patent application Ser. No. 09/955,690, filed concurrently herewith, and entitled "Attachment For Hair Clippers", the contents of which are incorporated by reference in their entirety. Among other things, the attachment 10 includes a base 122, a reciprocating blade 130 and a stationary blade 132. Guides 134, 136 are also provided. While two guides are shown, a one-piece construction is also contemplated. A rod 137 extends between the openings in the guides 134, 136 and through an opening 139 in the tether 22. The guides 134, 136 also include recesses 194 into which the stationary blade 16 fits, the guides 134, 136 extending over the top of the blade teeth of the stationary blade 16, as seen in FIG. 4.

The base 122 includes a bottom 138 and sides 140, 142. The sides 140, 142 lie along and capture the sides of the hair clipper blades. A snap 144 is provided for securement to the stationary blade of the hair clipper 10 in use, and an elongated depression 146 can be provided, if desired, to accommodate the embossment 24 when the attachment is stored in the housing.

The recessed area 21 can be any suitable design that holds and secures an attachment in place. In FIG. 3, the recessed area 21 includes a lip 30 and a recess 32. The blades 130, 132 of the attachment 10 fit into the recess 32, so that the outside surface of the base 122 in FIG. 3 is flush with the housing 14 when the attachment is stored. Another lip 34 and recess 36 are also provided. The snap 144 fits into the recess 36 and is retained by the lip 34 when the attachment 10 is stored. That end of the bottom of the attachment is also flush with the housing 14. Ears 37 are provided to pull the attachment away from the hair clipper. Another recess 38 is provided in the recessed area 21 for the tether 22.

FIG. 4 shows the attachment 10 secured to the stationary blade 16 of the hair clipper 10. The attachment is secured by rotating it over the hair clipper stationary blade and latching the snap 144. In this manner, the attachment is stored on one side of the hair clipper (FIG. 1), and used on the hair clipper blades on the other side of the hair clipper (FIG. 4).

Figure 5:
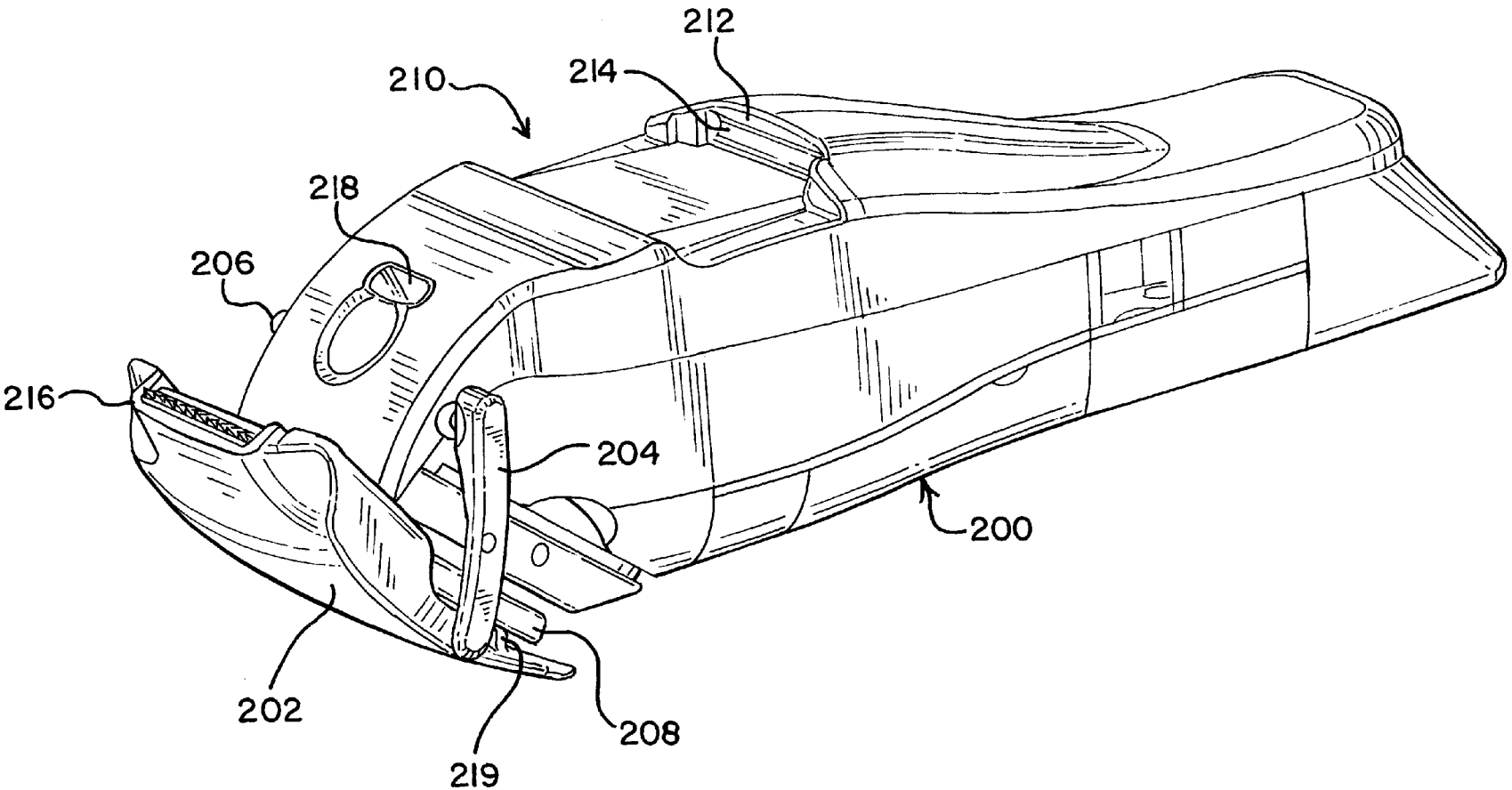
FIG. 5 is a perspective view of an alternate embodiment of the hair clipper of FIG. 1.

In FIG. 5, a hair clipper 200 includes an attachment 202 tethered by arms 204, 206, located on either side of the attachment 202. The arms 204, 206 are secured to the attachment 202 by any suitable means, such as a ball and socket joint. The arms 204, 206 can be secured to the hair clipper 200 in a similar manner, such that the attachment 202 can rotate from a stationary blade 208 on the hair clipper 202 to a recessed area 210 for storage purposes. The recessed area 210 includes a lip 212 and recess 214 into which blades 216 of the attachment 202 fit, and a recess 218 into which a snap 219 on the attachment 202 fits.

The many advantages of this invention are now apparent. Hair trimmer attachments are tethered to the hair clipper, so they are not lost. The attachments can be easily stored in the housing, which is convenient and orderly, and further prevents loss of the attachment. If the attachment is concealed in the hair clipper housing, the attachment does not interfere with the regular use of the hair clipper.

While the principles of the invention have been described above in connection with specific apparatus and applications, it is to be understood that this description is made only by way of example and not as a limitation on the scope of the invention. While a hair trimmer attachment has been described, it is contemplated that other devices, such as massagers, ear and nose hair trimmers and the like, could be attached to the hair clipper and driven in a similar manner.

What is claimed is:

1. A hair clipper comprising:

a housing;

hair clipper blades; and an attachment selectively secured to and removed from the hair clipper blades;

wherein the housing having means for receiving the attachment therein for storage purposes when the attachment is not secured to the hair clipper blades.

2. The hair clipper of claim 1, wherein the means for receiving is a recessed area and the attachment is stored in the recessed area so as to not interfere with regular use of the hair clipper when the attachment is stored.

3. The hair clipper of claim 2, wherein the recessed area includes at least one lip and one recess for securing the attachment in the housing.

4. The hair clipper of claim 1, wherein the attachment includes means for releasing the attachment from storage in the housing.

5. The hair clipper of claim 4, wherein the releasing means includes ears on the attachment.

6. A hair clipper comprising:

a housing;

a stationary blade, a reciprocating blade, a blade attachment; and a tether attached to the housing on one end by a first hinge and the attachment on the other end by a second hinge.

7. The hair clipper of claim 6, wherein the tether includes a first opening at the one end and a second opening at the other end, the tether being attached to the housing by a rod inserted through the first opening, the tether being attached to the blade attachment by a rod extending through the second opening.

8. The hair clipper of claim 6, wherein the tether is a single piece of flat material.

9. The hair clipper of claim 6, wherein the tether includes two arms located at sides of the blade attachment.

10. A hair clipper comprising:

a housing;

a stationary blade, a reciprocating blade, a blade attachment; and a tether attached to the housing on one end and the attachment on the other end;

wherein the tether includes two arms located at the sides of the blade attachment.

11. A hair clipper comprising:

a housing;

a stationary blade, a reciprocating blade, a blade attachment; and a tether attached to the housing on one end and the attachment on the other end;

wherein the tether includes a first opening at the one end and a second opening at the other end, the tether being attached to the housing by a rod inserted through the first opening, the tether being attached to the blade attachment by a rod extending through the second opening.

* * * * *